United States Patent [19]

Sato et al.

[11] 4,329,536

[45] May 11, 1982

[54] OIL-IMPREGNATED POWER CABLE

[75] Inventors: Atushi Sato, Tokyo; Isoo Shimizu, Yokohama; Keizi Endo, Yokohama; Hitoshi Yanagishita, Yokohama, all of Japan

[73] Assignee: Nippon Petrochemical Company, Ltd., Tokyo, Japan

[21] Appl. No.: 160,030

[22] Filed: Jun. 16, 1980

[30] Foreign Application Priority Data

Jun. 19, 1979 [JP] Japan ..... 54/763498

[51] Int. Cl.[3] ..... H01B 9/06

[52] U.S. Cl. ..... 174/25 C; 174/25 R; 252/567

[58] Field of Search ..... 174/25 R, 25 C; 252/567

[56] References Cited

U.S. PATENT DOCUMENTS

| | | | |
|---|---|---|---|
| 3,078,333 | 2/1963 | Kang | 174/25 R X |
| 3,194,872 | 7/1965 | Garner | 174/25 R |
| 3,462,358 | 8/1969 | Mills | 174/25 R X |
| 3,775,549 | 11/1973 | Matsuda | 174/25 R |
| 4,175,278 | 11/1979 | Sato | 252/567 |
| 4,237,334 | 12/1980 | Kojima | 174/25 R |

*Primary Examiner*—Richard R. Kucia

*Attorney, Agent, or Firm*—Scully, Scott, Murphy & Presser

[57] ABSTRACT

Provided is an oil-impregnated power cable comprising an insulation layer formed by winding a composite film of polyolefin film and insulating paper onto an electric conductor and impregnated with an impregnating oil, said impregnating oil comprising distillates within a boiling range in terms of values at normal pressure between 265° C. and 360° C. obtained by contacting a hydrocarbon mixture with a boiling range between 75° C. and 198° C. resulting from a thermal cracking of petroleum hydrocarbons at a temperature of 700° C. or higher and containing monocyclic aromatics and aromatic olefins, in liquid phase with an acid catalyst.

6 Claims, No Drawings

OIL-IMPREGNATED POWER CABLE

BACKGROUND OF THE INVENTION

The present invention relates to an oil-impregnated power cable. More particularly, it is concerned with a power cable impregnated with an oil which oil is obtained from starting materials of a specific composition and by a specific manufacturing process, and having an insulation layer which is formed of a composite film of polyolefin film and insulating paper.

In recent years, the demand for high load voltages an oil-impregnated power cables has been increasing. And to meet this demand there have been made various improvements with respect to the structure of power cables, particularly the insulation layer thereof. For example, an attempt has been made to substitute the conventional insulating papers by a polyolefin film having a higher dielectric strength and a smaller dielectric loss for use in the cable insulation layer. However, polyolefin films impregnated with conventional impregnating oils sometimes become swollen, which causes drawbacks, e.g. increased oil flow resistance.

In order to avoid such drawbacks associated with the prior art, it has been proposed to use both a polyolefin film and an insulating paper and thereby form an insulation layer for power cables. In this case, however, if such a method as has been applied for the manufacture of oil-impregnated condensers, namely a mere overlapping and winding of polyolefin film and insulating paper, is applied to the manufacture of cables, there sometimes occur shears and wrinkles between insulation elements because of a cable bending.

It is therefore necessary to effect bonding between polyolefin film and insulating paper by some means so as not to cause shears and wrinkles. In this case, care must be exercised so as not to lower the adhesive strength against a long-term impregnation in oil. Conventional impregnating oils still leave something to be desired in these respects. Of course, even with a power cable using such composite film of polyolefin film and insulating paper, the foregoing problem of oil flow resistance is an important subject.

It is an object of the present invention to provide an oil-impregnated power cable free from the aforesaid drawbacks encountered in the conventional oil-impregnated power cables.

It is another object of the present invention to provide an oil-impregnated power cable permitting application of increased load voltages, having smaller dielectric loss and oil flow resistance and undergoing neither shears nor wrinkles caused by a cable bending.

Other objects of the present invention will become clear from the following description.

SUMMARY OF THE INVENTION

The foregoing objects of the present invention are attained by an oil-impregnated power cable comprising an insulation layer formed by winding a composite film of polyolefin film and insulating paper onto an electric conductor and impregnated with an impregnating oil, said impregnating oil comprising distillates within a boiling range (in terms of values at normal pressure) between 265° C. and 360° C. obtained by contacting a hydrocarbon mixture which results from a thermal cracking of petroleum hydrocarbons at a temperature of 700° C. or higher and which contains principally components with a boiling range between 75° C. and 198° C. consisting essentially of monocyclic aromatics and further contains aromatic olefins of the boiling range just defined above, in liquid phase with an acid catalyst.

DESCRIPTION OF THE INVENTION

The hydrocarbon mixture which may be used in manufacturing the impregnating oil of the present invention is one obtainable by a thermal cracking of petroleum hydrocarbons at a temperature of 700° C. or higher and containing principally components with a boiling range between 75° C. and 198° C. consisting essentially of monocyclic aromatics and further containing aromatic olefins of the said boiling range.

As the hydrocarbons mixture may be used distillates mainly containing components with a boiling range between 75° C. and 198° C. among by-product distillates obtained when petroleum hydrocarbons such as crude oil, naphtha, kerosene, LPG, butane and the like are cracked at a temperature of 700° C. or higher to produce ethylene and propylene. The distillates, though the composition thereof differs depending upon the petroleum hydrocarbons fed to the thermal cracking, contains monocyclic aromatics having 6 to 10 carbon atoms as the major component, further contains 5–15% by weight of saturated aliphatic hydrocarbons, 2–10% by weight of unsaturated aliphatic hydrocarbons and 2–15% by weight of aromatic olefins. The distillates may be used as they are as the hydrocarbon mixture in the invention, but the components of the distillates isolated or synthesized may optionally be added or blended together, or may be used by adding or blending in the said distillates. Alternatively, a hydrocarbon mixture with the same composition as that of the above-mentioned cracked by-product oil, which is obtained by adding to or blending with distillates of the above-defined boiling range from a catalytically reformed oil of petroleum hydrocarbons such as naphtha other components within said boiling range from cracking of petroleum hydrocarbons, may also be used as the hydrocarbon mixture in the invention.

It is believed that, among the components with a boiling range between 75° C. and 198° C. of the aforesaid distillates, monocyclic aromatic components such as benzene, toluene, xylenes, cumene, propylbenzenes, methylethylbenzenes, trimethylbenzenes, diethylbenzenes and tetramethylbenzenes react with other olefinic components in the presence of an acid catalyst to thereby form a heavy component within a boiling range in terms of values at normal pressure between 265° C. and 360° C. useful as an impregnating oil. This heavy component is a mixture of various aromatic hydrocarbons, in which the presence of heavy products produced by employing as the starting materials a hydrocarbon mixture containing olefins such as styrene, methylstyrenes, ethylstyrenes and the like is essential to the impregnating oil used in the present invention.

It is therefore necessary that the starting hydrocarbon mixture mainly contain components with a boiling range between 75° C. and 198° C. among the components obtained by thermal cracking of petroleum hydrocarbons.

Components with a boiling range over 198° C. contain condensed polycyclic aromatic hydrocarbons such as naphthalene and alkylnaphthalenes, while components with a boiling range below 75° C. contain much dienes such as cyclopentadiene, and the presence of these components wll cause formation of viscous high-boiling compounds upon treatment with an acid catalyst.

The acid catalysts used in the present invention are preferably solid acid catalysts, mineral acids and so-called Friedel-Crafts catalysts. For example, acidic clay minerals such as acid clay and activated clay, hydrogen fluoride, sulfuric acid, phosphoric acid, aluminum chloride, zinc chloride, and boron fluoride may be employed.

As preferred examples of the solid acid catalyst are mentioned natural clay minerals. Typical clay minerals are kaolinic halloysite clay mineral and montmorillonite clay mineral, which are known as acid clay and subbentonite. Also may be employed activated clay from treatment of the aforementioned clay minerals for example with an inorganic acid such as sulfuric or hydrochloric acid, or an organic acid such as acetic or formic acid, or an aqueous solution thereof. In addition to natural clay minerals, synthetic silica-alumina is a preferred solid acid catalyst, too. It is also preferred to use an inorganic acid such as sulfuric acid, phosphoric acid or hydrogen fluoride, with which due consideration is needed for corrosion of the equipment.

It is necessary that the treatment with an acid catalyst be carried out in liquid phase. To this end, the starting hydrocarbon mixture may be maintained in liquid phase at the reaction temperature while applying pressure to an appropriate extent. The conditions for the treatment with an acid catalyst usually involves reaction temperatures ranging from 0° to 200° C. and liquid residence times from 0.1 to 5.0 hours.

The reaction temperature in the treatment with an acid catalyst is important. Below 0° C., undesirable tarry substances will be formed due to polymerization reaction of unsaturated components of the cracked oil to reduce the yield of the impregnating oil. Above 200° C., heat deterioration of the reaction mixture will cause deterioration of the properties of the impregnating oil distillates. The reaction temperature is varied depending upon the catalyst employed. Preferred temperatures are above 100° C. for the solid acid catalyst and below 100° C. for the mineral acid or Friedel-Crafts catalyst.

The liquid residence time is preferably from 0.1 to 5 hours. The period of time less than 0.1 hour will not complete the reaction of unsaturated components, principally aromatic olefins contained in the starting hydrocarbon mixture thereby undesirably reducing the yield of useful impregnating oil. On the other hand, contact with the acid catalyst for a period longer than 5 hours is not desirable because it will cause re-decomposition of the reaction product.

In order to produce the impregnating oil distillates in a high yield, it is preferable that the concentration of aromatic olefins present in the reaction system to be treated with an acid catalyst is below 10% by weight. Too high concentration of aromatic olefin and other unsaturated components in the reaction system will increase heavier tarry components due to polymerization of the unsaturated components thereby remarkably decreasing the yield of the impregnating oil distillates. The unsaturated polymers formed also will be incorporated into the impregnating oil distillates. Since the content of aromatic olefins in the distillates of cracked oil in the above-cited boiling range is usually 10% by weight or above, it is preferable that in carrying out the reaction, aromatics, including xylene or unreacted distillate, be added to adjust the content of aromatic olefins in the reaction system to a value below 10% by weight.

Among the reaction products from treatment of the starting hydrocarbon mixture with an acid catalyst, distillates within a boiling range (in terms of values at normal pressure) between 265° C. and 365° C. are used as the impregnating oil for the oil-impregnated power cable of the present invention.

Distillates containing components with boiling points higher than 365° C. are so viscous that their impregnating property is poor. On the other hand, distillates with boiling points lower than 265° C. are low in flashing point so that they are not desirable as an impregnating oil.

The aforesaid impregnating oil may be purified by hydrotreating or clay treating process.

The impregnating oil so far described of the present invention is characteristic in that the insulation resistance and dielectric strength of the oil itself are high and the hydrogen gas absorbability is also high and in that the spreading and impregnating properties for polypropylene and other polyolefin films are superior with less swelling tendency for these films.

The impregnating oil may be mixed with other known impregnating oils such as mineral oils, alkylbenzene, polybutene, alkylnapthalene, alkylbiphenyl, and diarylalkane. For example, a mineral oil may be incorporated to reduce cost, or a silicone oil to improve swelling performance still further.

The impregnating oil to be used in the present invention usually contains sulfur compound in the range of from 10 to 500 ppm, more preferably from 10 to 100 ppm, due to the raw material. The power cable impregnated with the aforesaid sulfur containing oil exhibits marked thermal stability and antioxidation property.

In the manufacture of the oil-impregnated power cable of the present invention, the impregnating oil prepared in the hereinabove-described manner is impregnated into the insulation layer formed by a composite film of polyolefin film and insulating paper.

In more particular terms, the composite film consists of at least one layer of polyolefin film and at least one layer of insulating paper both laminated together by such bonding means as melt-adhesion and/or chemical bonding. Specially preferred is of the structure in which the insulating paper is laminated onto one or both sides of the polyolefin film.

The polyolefins as referred to herein include homopolymers of $\alpha$-olefins having up to 12 carbon atoms such as ethylene, propylene, butene-1 and 4-methylpentene-1, for example, high-, medium or low-density polyethylenes and polypropylenes, and also copolymers of these olefins, for example, copolymers of ethylene and other $\alpha$-olefins falling under what has just been defined above, such as those with densities in the range of from 0.890 to 0.945. The polyolefins are obtained by slurry, solution or vapor phase polymerization of for example ethylene in the presence of a so-called Ziegler type catalyst consisting of a titanium and/or vanadium containing compound and an organoaluminum, or a chromium oxide catalyst. The Ziegler type catalyst sometimes further contains a magnesium compound. Polymerizing ethylene at a high pressure in the presence of a radical generator is also one route to the polyolefin.

A preferred example of a composite film using such polyolefins is one formed by melt-extrusion of polyolefin and subsequent melt-bonding of the extruded polyolefin to an insulating paper. The melt-extrusion is carried out in such a manner that polyolefin is heat-melted by an extruder or the like and then extruded in the form of a film onto an insulating paper through a T-die or the like followed by pressure-bonding with rolls to form a composite film. In this case, before the polyolefin solidifies on cooling, a further insulating paper or oriented polyolefin film, e.g. a biaxial oriented polypropylene film (OPP film), may be pressure-bonded thereto.

In the formation of the composite film, the use of polyolefins with a higher crystallinity, for example, the use of polypropylene rather than polyethylene, is preferred.

The polyolefins used in the present invention may be modified cross-linked ones obtained for example by introducing a cross-linkable functional group into the polyolefins and thereafter allowing cross-linking to take place. Such modified cross-linked polyolefins include cross-linked silane grafted polyolefins. And a composite film using such polyolefins can be prepared by melt-laminating a silane grafted polyolefin to an insulating paper and allowing cross-linking to take place in the presence of a silanol condensation catalyst, for example, by the method disclosed in British Patent No. 1,536,562 (BICC Ltd.).

To be more specific, silane compounds (hereinafter referred to simply as "silane") such as vinyltrimethoxysilane (VTMOS) and vinyltriethoxysilane (VTEOS) having vinyl groups or the like capable of being grafted to polyolefins and hydrolyzable silyl groups are heat-kneaded together with a radical generator by means of an extruder or the like to allow the silane to be grafted to polyolefin to give a silane grafted polyolefin. The silane grafted polyolefin is then fed into an extruder together with a silanol condensation catalyst such as dibutyltindilaurate or dibutyltindiacetate, extruded through a T-die onto an insulting paper and, before solidifying on cooling, is contacted with another insulating paper, thereafter the moisture of the insulating paper is reacted with the silane which is grafted to the polyolefin to thereby complete cross-linking. As the water for cross-linking the moisture of the insulating paper itself may be utilized, or alternatively a steam or a warm water may be supplied from the exterior.

The silanol condensation catalyst may be kneaded together with the grafted polyolefin as mentioned above. Alternatively, the grafted polyolefin may be melt-bonded together under pressure and thereafter the resulting laminate may be sprayed with a solution or dispersion of the silanol condensation catalyst or immersed therein.

In addition to the aforesaid melt-bonding to a laminate between the grafted polyolefin and an insulating paper, the laminate may also be formed by applying a hot xylene solution of the grafted polyolefin onto the insulating paper. Also in this case, the silanol condensation catalyst is added beforehand into the solution or is let adhere to the surface after application of the solution.

It is presumed that a part of the foregoing hydrolyzable silyl groups of the grafted polyolefin is directly reacted and bonded with alcoholic hydroxyl groups in the cellulose molecule constituting the insulating paper; as a result, the bonding strength between the polyethylene film and the insulating paper and the oil resistance of the composite film are improved.

In the formation of a composite film utilizing such a silane cross-linking, the use of polyethylenes among polyolefins is preferred because it will allow a graft reaction of silane to take place to a satisfactory extent and afford a composite film having a high bonding strength. Among polyethylenes, moreover, high density polyethylenes are preferred because they contribute to the improvement in oil resistance.

In the composite film as a constituent of the power cable of the present invention, it is suitable that the thickness of the polyolefin film be 40μ to 120μ, that of the insulating paper be 10μ to 60μ, that of the composite film with insulating paper laminated onto both sides of the polyolefin film be 100μ to 250μ and that of the composite film with laminated insulating paper and polyolefin film one layer each be 50μ to 180μ.

The insulation layer of the power cable of the invention is constituted by a composite film consisting of a polyolefin film such as a polyethylene or polypropylene film and an insulating paper, the composite dielectric constant of the composite film being relatively close to that of the impregnating oil prepar-d in the hereinbefore-described manner, which is a reason why the oil-impregnated power cable of the present invention is extremely superior in dielectric strength, especially in impulse breakdown voltage.

The impregnating oil used for the power cable of the present invention is the one proposed in U.S. Pat. No. 4,175,278 filed by the applicant in the present case, but it is unforeseen that such impregnating oil exhibits remarkable effects when used in the power cable of the invention.

Working examples of the present invention are given below to illustrate the invention more in detail.

EXAMPLE OF IMPREGNATING OIL PREPARATION

In an autoclave 10 liters in volume are placed 1 l of cracked by-product oil from ethylene production, 1 l of xylene and 100 g. of acid clay. The oil contains 94.6% by weight of components with a boiling range between 75° C. and 198° C., the initial distilling temperature being 68° C. and the 97%-distilling temperature being 175° C., and it is of a composition of 13.7% by weight of saturated aliphatics, 68.5% by weight of monocyclic aromatics, 17.8% by weight of olefins, mainly aromatic olefins and 48 ppm of sulfur compound. The autoclave pressurized with 30 kg/cm$^2$ of nitrogen, heated with stirring and maintained at a temperature of 150° C. In the course of the temperature rise up to 150° C., if rapid temperature rise is observed around a temperature of 110° C. due to the reaction heat, it is preferred to discontinue the heating temporarily. The, additional 5 l of the above-mentioned by-product oil is added dropwise over a period of 3 hours. After completion of the addition, heating with stirring is continued for additional 1 hour.

After cooled, the acid clay is separated by filtration. Under normal pressure is recovered 3.65 kg. of a lighter distillate distilling up to a temperature of 190° C. Under reduced pressure at 3 mmHg is then recovered the following separated distillates.

| Distillate | Distillation range (3mmHg) (°C.) | Boiling range at normal pressure (°C.) | Yield (g) | |
|---|---|---|---|---|
| 1 | 60–110 | 195–265 | 340 | Distillate 1 in Comparative Example |
| 2 | 110–185 | 265–340 | 850 | Impregnating oil of the invention |

-continued

| Distil-late | Distil-lation range (3mmHg) (°C.) | Boiling range at normal pressure (°C.) | Yield (g) | |
|---|---|---|---|---|
| 3 | 185–240 | 340–425 | 240 | Distillate 3 in Comparative Example |
| 4 | — | — | 140 | Distillation residue |

To distillates 1–3 is added 2.5% by weight of active clay, and the clay treatment is performed under nitrogen atmosphere at a temperature of 50° C. for a period of 2 hours. Properties of the distillates and known impregnating oils, mineral oil (MO), alkylbenzene (AB), alkylnaphthalene (AN) and polybutene (PB) are shown in table 1 below.

TABLE 1

| | Impregnating oil used in the invention | Comparative Example | | | | | |
|---|---|---|---|---|---|---|---|
| | | MO | AB | AN | PB | Distillate 1 | Distillate 3 |
| Viscosity (cst 100° F.) | 4.9 | 6.4 | 10.5 | 10.0 | 137 | 3.4 | 540 |
| Flashing point (PMCC °C.) | 145 | 135 | 125 | 140 | 135 | 73 | 200 |
| Pour point (°C.) | ≦−50 | −34 | ≦−50 | ≦−50 | −48 | ≦−50 | 5 |
| Volume resistivity (80° C., Ωcm) | $4 \times 10^{15}$ | $1 \times 10^{14}$ | $9 \times 10^{15}$ | $3 \times 10^{15}$ | $2 \times 10^{15}$ | — | — |
| Dielectric constant (80° C.) | 2.5 | 2.1 | 2.2 | 2.4 | 2.0 | — | — |
| BDV (KV/2.5mm, 80° C.) | ≧70 | 52 | 68 | ≧70 | 43 | — | — |
| tan δ (%, 80° C.) | 0.03 | 0.02 | 0.02 | 0.03 | 0.03 | — | — |

Due to its lower flashing point, Distillate 1 is not preferable from the safety point of view as the impregnating oil for the oil-impregnated power cable of the invention. Distillate 3 is also unpreferable due to its higher pour point and viscosity by which residual bubbles will readily be formed between insulation elements at the time of oil impregnation to the power cable and the impregnating oil will be difficult to flow in colder places, resulting in the power cable being deteriorated in performance.

EXAMPLE OF COMPOSITE FILM PREPARATION

Composite Film 1

Two sheets of an insulating kraft paper (43μ thick) were bonded together through the medium of a melt-extruded propylene from a T-die connected with the extruder to give a composite film 1, the thickness of the composite film 1 being in such a ratio as kraft paper (43μ)/polypropylene (49μ)/kraft paper (43μ).

In the same manner was also formed a composite film 1′ of two layers with a thickness ratio of kraft paper (43μ)/polypropylene (49μ).

Composite Film 9

100 parts by weight of a high-density polyethylene, 0.15 part by weight of DCP and 2.0 parts by weight of VTMOS were heat-kneaded at a temperature of about 200° C. by an extruder to obtain pellets of silane grafted polyethylene. To 100 parts by weight of the pellets was then added 0.05 part by weight of dibutyltindilaurate, and the mixture was extruded between two sheets of an insulating paper through a T-die connected with the extruder and pressure-bonded thereto before solidifying on cooling. In this case, a steam treatment or like treatment may be applied to complete the cross-linking of the silane. Usually, however, such additional treatment is not needed, the moisture from heating for drying the composite film allows cross-linking to proceed. The film thus formed had a thickness ratio of kraft paper (43μ)/polyethylene (49μ)/kraft paper (43μ).

In the same manner was also formed a composite film 2′ of two layers with a thickness ratio of kraft paper (43μ)/polyethylene (49μ).

Then, using the composite films thus prepared and impregnating oils, there were manufactured model cables in such a manner that each of the composite films was cut into a tape 20 mm wide and then wound, with a stress of 0.5 kg/tape width, onto a copper pipe 30 mm in diameter as an electric conductor to form an insulation layer with a thickness of 4.5 mm, the exterior of which was covered with corrugated aluminum pipe through the medium of a carbon paper, then the so-manufactured model cable were vacuum-dried at $10^{-3}$ mmHg and at 100° C. for 12 hours and thereafter impregnated with a degassed dried impregnating oil. After heating at 100° C. for a period of 30 days, the so-manufactured model cables were subjected to impulse breakdown test and were checked for the change in thickness of the insulation layer before and after the heating. AC breaking strength after bending test was also measured.

TABLE 2

| | Impregnating Oil | Constitution of Insulation Layer | Impulse Breakdown Strength (KV/mm) Initial | After 30 days at 100° C. | Change in Thickness of Insulation Layer after heating (%) | AC Breaking Strength (KV/mm) Before | After |
|---|---|---|---|---|---|---|---|
| Example 1 | Impregnating Oil in the | Composite Film 1 | 98 | 88 | 2 | 60 | 60 |

TABLE 2-continued

| | Impregnating Oil | Constitution of Insulation Layer | Impulse Breakdown Strength (KV/mm) Initial | After 30 days at 100° C. | Change in Thickness of Insulation Layer after heating (%) | AC Breaking Strength (KV/mm) Before | After |
|---|---|---|---|---|---|---|---|
| Example 2 | Preparation Example Impregnating Oil in the Preparation Example | Composite Film 2 | 100 | 95 | 1 | 62 | 61 |
| Comparative Example 1 | Alkylnaphthalene | Composite Film 1 | 95 | 55 | 7 | 60 | 40 |
| Comparative Example 2 | Polybutene | Composite Film 2 | 70 | 60 | 5 | 55 | 41 |
| Comparative Example 3 | Alkylbenzene (Dedecylbenzene) | Composite Film 1 | 95 | 60 | 5 | 60 | 42 |
| Comparative Example 4 | Alkylbiphenyl (Monoisopropylbiphenyl) | Composite Film 1 | 95 | 65 | 7 | 60 | 39 |
| Comparative Example 5 | Mineral oil | Composite Film 1 | 70 | 55 | 9 | 51 | 40 |
| Example 3 | Impregnating Oil in the Preparation Example | Composite Film 1' | 121 | 109 | 3 | 80 | 77 |
| Example 4 | Impregnating Oil in the Preparation Example | Composite Film 2' | 130 | 122 | 3 | 80 | 79 |

We claim:

1. An oil-impregnated power cable comprising an insulation layer formed by winding a composite film onto an electric conductor and impregnated with an impregnating oil, said composite film comprising a laminate obtained by bonding at least one layer of the insulating paper by means of melt-adhesion or chemical bonding, said impregnating oil comprising distillates within a boiling range in terms of values at normal pressure between 265° C. and 360° C. which distillates contain sulfur compounds in the range of from 10 to 500 ppm and are obtained by contacting a hydrocarbon mixture which mixture results from a thermal cracking of petroleum hydrocarbons at a temperature of 700° C. or higher and which mixture contains principally components with a boiling range between 75° C. and 198° C. consisting essentially of monocyclic aromatics and further contains aromatic olefins of the boiling range just defined above, in liquid phase with an acid catalyst.

2. The oil-impregnated power cable as defined in claim 1, in which said treatment with the acid catalyst has been carried out under the conditions of a reaction temperature in the range of from 0° to 200° C., a liquid residence time from 0.1 to 5 hours and an initial concentration of aromatic olefins in the reaction system lower than 10% by weight.

3. The oil-impregnated power cable as defined in claim 1, in which said polyolefin film is a film of a polyolefin melt-extruded onto the insulating paper.

4. The oil-impregnated power cable as defined in claim 1, in which said polyolefin is polypropylene.

5. The oil-impregnated power cable as defined in claim 1, in which said polyolefin film is a film of a silane grafted polyolefin melt-bonded to the insulating paper and being in a cross-linked state created in the presence of a silanol condensation catalyst.

6. The oil-impregnated power cable as defined in claim 5, in which said silane grafted polyolefin is a silane grafted high-density polyethylene.

* * * * *